US007422054B2

(12) United States Patent
Dierbeck

(10) Patent No.: US 7,422,054 B2
(45) Date of Patent: Sep. 9, 2008

(54) HEAT EXCHANGER ASSEMBLY FOR A CHARGE AIR COOLER

(76) Inventor: Robert F. Dierbeck, 2707 Hall Rd., Hartford, WI (US) 53027

( * ) Notice: Subject to any disclaimer, the term of this patent is extended or adjusted under 35 U.S.C. 154(b) by 399 days.

(21) Appl. No.: 11/260,767

(22) Filed: Oct. 27, 2005

(65) Prior Publication Data

US 2006/0048931 A1 Mar. 9, 2006

Related U.S. Application Data

(63) Continuation-in-part of application No. 09/977,675, filed on Oct. 15, 2001, now abandoned, which is a continuation-in-part of application No. 09/356,188, filed on Jul. 16, 1999, now abandoned.

(51) Int. Cl.
*F28F 9/18* (2006.01)

(52) U.S. Cl. ..... 165/173; 165/175; 165/178; 165/181; 165/906

(58) Field of Classification Search ..... 165/173, 165/175, 178, 181, 906
See application file for complete search history.

(56) References Cited

U.S. PATENT DOCUMENTS

| | | | | |
|---|---|---|---|---|
| 1,810,286 | A | 6/1931 | MacPhee | |
| 1,955,015 | A | 4/1934 | Price | |
| 2,368,391 | A | 1/1945 | Young | |
| 3,165,151 | A | 1/1965 | Astrup et al. | |
| 3,245,465 | A | 4/1966 | Young | |
| 3,391,732 | A | 7/1968 | Murray | |
| 3,447,602 | A | 6/1969 | Dalin | |
| 3,489,209 | A | 1/1970 | Johnson | |
| 3,981,354 | A | 9/1976 | Haberski | |
| 4,034,802 | A | 7/1977 | Schwarz | |
| 4,298,062 | A | 11/1981 | Pasternak | |
| 4,586,565 | A | 5/1986 | Hallstrom et al. | |
| 4,872,578 | A | 10/1989 | Fuerschbach et al. | |
| 5,113,930 | A | 5/1992 | le Gauyer | |
| 5,150,520 | A | 9/1992 | DeRisi | |
| 5,178,211 | A * | 1/1993 | Bauer et al. | 165/173 |
| 5,228,515 | A | 7/1993 | Tran | |
| 5,303,770 | A | 4/1994 | Dierbeck | |

(Continued)

FOREIGN PATENT DOCUMENTS

| | | |
|---|---|---|
| GB | 2 059 562 | 4/1981 |

(Continued)

*Primary Examiner*—Leonard R Leo
(74) *Attorney, Agent, or Firm*—Andrus, Sceales, Starke & Sawall, LLP

(57) ABSTRACT

A heat exchanger assembly for an internal combustion engine charge air cooler is formed from a plurality of aluminum modules, each provided with longitudinal through bores and opposite outer face portions with toothed heat exchange fins positioned in face-to-face relation. The assembly of tubular modules is interconnected with upper and lower aluminum header plates which receive the ends of the tubular modules and are secured thereto with fused joints made from the parent material of the modules and header plates. The openings in the header plates for the modules are flanged and have a thickness of at least about 0.090 inch and the wall thickness of the ends of the tubular modules also have a minimum thickness of about 0.90 inch such that the fused joints utilize substantially equal amounts of aluminum material from the modules and the header plate flanges.

4 Claims, 3 Drawing Sheets

U.S. PATENT DOCUMENTS

| | | | |
|---|---|---|---|
| RE35,098 | E | 11/1995 | Saperstein |
| 5,803,162 | A | 9/1998 | Karbach et al. |
| 6,032,726 | A | 3/2000 | Wright et al. |
| 6,173,493 | B1 | 1/2001 | Dierbeck |
| 6,374,911 | B1 | 4/2002 | Olson et al. |

FOREIGN PATENT DOCUMENTS

| | | | |
|---|---|---|---|
| JP | 52-30916 | | 9/1977 |
| JP | 57-207797 | | 12/1982 |
| JP | 63113300 | | 5/1988 |
| JP | 4-208391 | | 7/1992 |
| JP | 4-371799 | | 12/1992 |
| WO | WO 9919683 | A | 4/1999 |

* cited by examiner

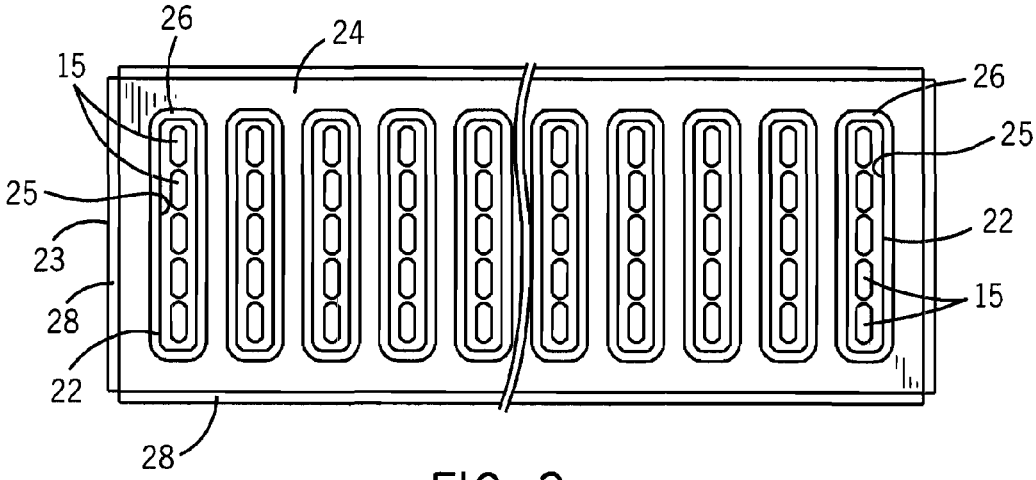
FIG. 3
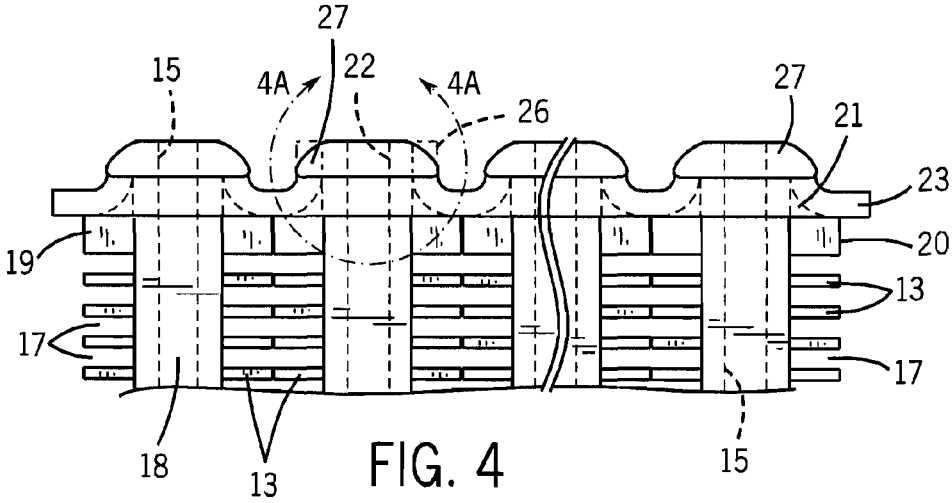
FIG. 4
FIG. 4A
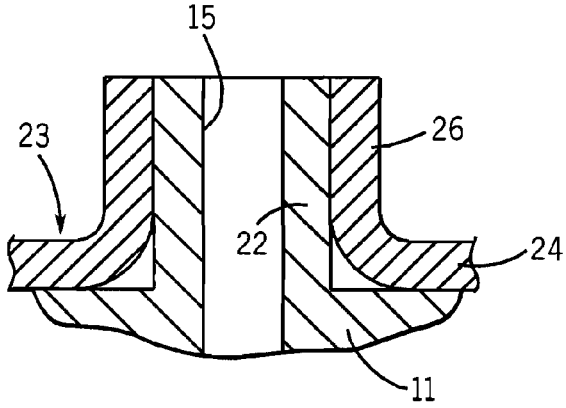

HEAT EXCHANGER ASSEMBLY FOR A CHARGE AIR COOLER

CROSS REFERENCE TO RELATED APPLICATIONS

This application is a continuation-in-part of application Ser. No. 09/977,675, filed Oct. 15, 2001, now abandoned, which is a continuation-in-part of application Ser. No. 09/356,188, filed on Jul. 16, 1999, now abandoned.

FIELD OF THE INVENTION

The present invention relates to heat exchangers used to cool various flowing fluids. More particularly, the invention relates to a heat exchanger assembly for use in cooling engine oil, transmission fluid, exhaust, or charge air for a supercharged engine by passing a cooling fluid around or through the exchanger.

BACKGROUND OF THE INVENTION

Heat exchangers are used to transfer heat absorbed by a first fluid to a second cooling fluid. Either fluid may flow through passages located within the exchanger or around the passages, passing through openings extending through the exchanger that are spaced about the passages and are defined by a plurality of fins extending outwardly around the passages. Prior art heat exchangers have been constructed in a multitude of arrangements to expose the maximum surface area on the passages and the surrounding fins to allow the greatest heat transfer to occur between the first and second fluids.

Older heat exchangers consist of arrangements of tubular passages having radially extending fins spaced from one another and attached to the passages in a permanent relationship. Heat exchangers of this type, while effective in cooling the heated first fluid flowing from the engine, are difficult to maintain and repair due to the unitary construction of the heat exchanger, as this construction necessitates the total disassembly of the exchanger to repair the exchanger. Disassembling these types of exchangers requires that the permanent connections between the components of the heat exchanger be undone, a process which is both time consuming and expensive.

More recent developments with regard to fluid heat exchanger design have resulted in the creation of modular heat exchangers, such as that disclosed in U.S. Pat. No. 5,303,770. In this heat exchanger, the exchanger is comprised of a number of aluminum modules that are positioned against one another to form the modular heat exchanger. Each module disclosed in the above-identified patent consists of an elongate, rectangular extruded aluminum block including longitudinally extending oval-shaped passages and a series of outwardly extending fins spaced around the passages along the exterior of the block on the wide face thereof.

The modules are preferably welded together with end pieces or header plates formed of the same metal as the modules to insure weld integrity and to avoid potential problems of weld failure resulting from differential thermal expansion in dissimilar metals. Therefore, to avoid these problems, the inlet and outlet end pieces or header plates, as well as the accumulator tanks or any other attachments connected to the modular elements, should be formed of aluminum to insure that the welded connections will not fail. This necessarily limits the application of the modular heat exchanger comprised of the extruded aluminum block modules to uses in which any necessary attachments welded to the heat exchanger, and any other elements welded to those attachments, can be formed of the same metal as the exchanger elements.

SUMMARY OF THE INVENTION

The present invention is a heat exchanger designed for use as an air charge cooler. The body of the heat exchanger is comprised of individual modules similar to those disclosed in U.S. Pat. No. 5,303,770, which is herein incorporated by reference. The modules are generally rectangular extruded tubular blocks that include at least one, but preferably two or more, longitudinal passages extending through the block and a number of V-shaped grooves extending along the wide face portions of the block. A plurality of slots are cut transversely into the grooves to form fins disposed along the wide face portions of the block covering substantially the entire length of the block.

The grooves to either side of the counterbores extend through the face portions to the opposite ends of the blocks to form additional channels through which a fluid may flow. These channels may be closed off by welding when the block is utilized for certain specific purposes to control the flow of fluid through the exchanger.

The construction of the preferred embodiments also utilize a unique arrangement of aluminum header plates to separate the two fluids and to position the unitary modules that form the heat exchanger assembly. The modules are formed with narrowed necks at each end defining the end of the pattern of toothed fins, the necks also surrounding and defining the end openings to the through bore. A header plate for each end of the plurality of modules forming an assembly is sized to receive the necks of the modules and to interconnect and hold the modules in the assembly. Each header plate is supported at the end of the assembly on the end-most fins and closes the space defined by the fins between the necks of adjacent modules. The peripheral edge of each header plate generally coincides with the outer periphery of the assembly of modules. Each header plate is connected to the assembly with fused joints. Finally, an aluminum a tank having a continuous outer edge is connected to the peripheral edge of each header plate along a fluid tight fused or welded joint.

A preferred embodiment is particularly adaptable for use in a charge air cooler where charge air may be heated to 600° F. (315° C.) or higher and where conventional brazed joints will fail. The slots that are cut in the faces of the modules do not extend the full length of the module, but rather terminate on both ends in endmost fins of a thickness greater than the fines therebetween. Each of the ends, in turn, terminates in a shoulder that defines a neck surrounding and defining an end opening to the module throughbore. The header plate is supported on the shoulders of adjacent modules forming the assembly and closes the space between the necks of adjacent modules. In this embodiment, the header plate comprises a generally flat main body portion with upturned flanged openings for receipt of the necks of the modules. The main body portion of the header plate is surrounded by a peripheral outer rim that encloses the plate body portion and forms a lip to which a tank can be fused or welded.

The flanged openings in the header plate are sized to receive the necks of the modules forming the assembly. The thickness of the neck walls, surrounding the through bores, and the thickness of the header plate flanges are preferably equal and at least 0.090 inch (2.3 mm) in thickness. The edges of the flanges and immediately adjacent edges of the necks are fused using approximately equal parts of neck material and flange material to form the fused joints. An aluminum tank may then be connected to the peripheral edge of each header plate with a welded or fused joint.

BRIEF DESCRIPTION OF THE DRAWINGS

FIG. 3 is a top plan view of the module/header plate assembly before fusing.

FIG. 4 is a front elevation detail of the assembly with the header plate fused to the ends of the tubular modules and showing one end before fusing.

FIG. 4*a* is a detail of FIG. 4 showing a connection before fusing.

DETAILED DESCRIPTION OF THE PREFERRED EMBODIMENT

Figure 1:
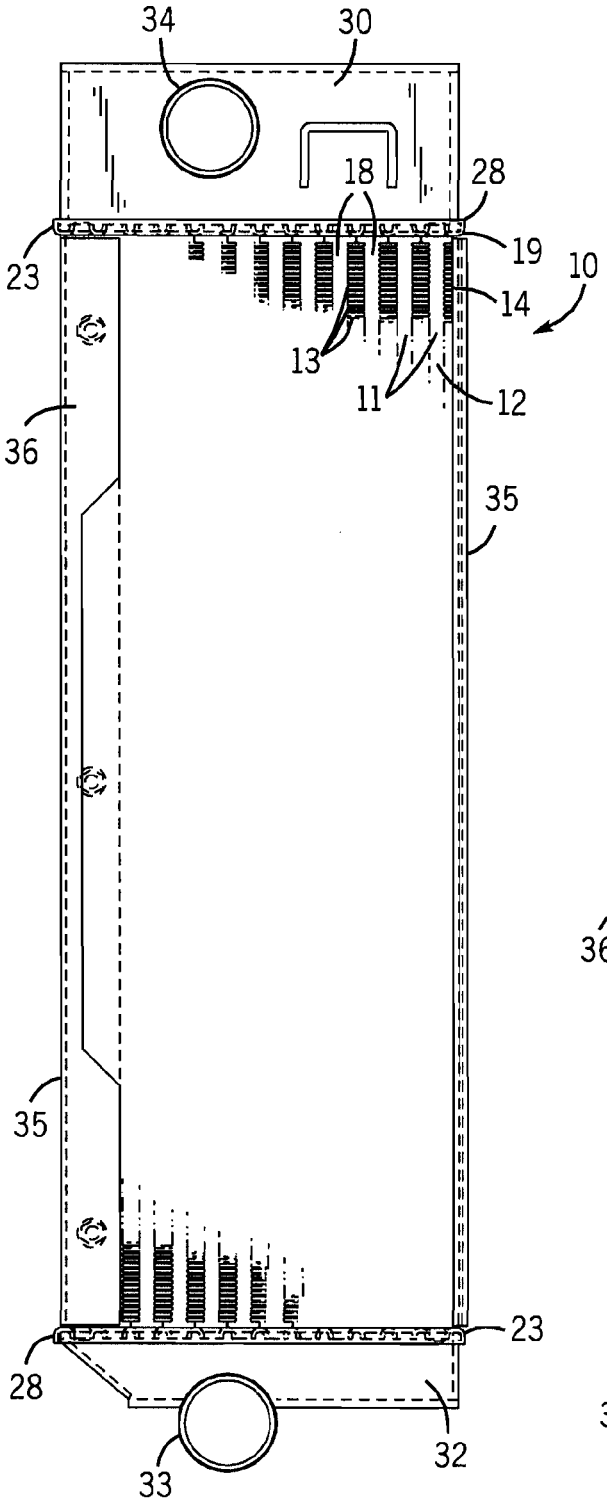
FIG. 1 is a front elevation view of a charge air cooler assembly in accordance with the present invention.
Figure 2:
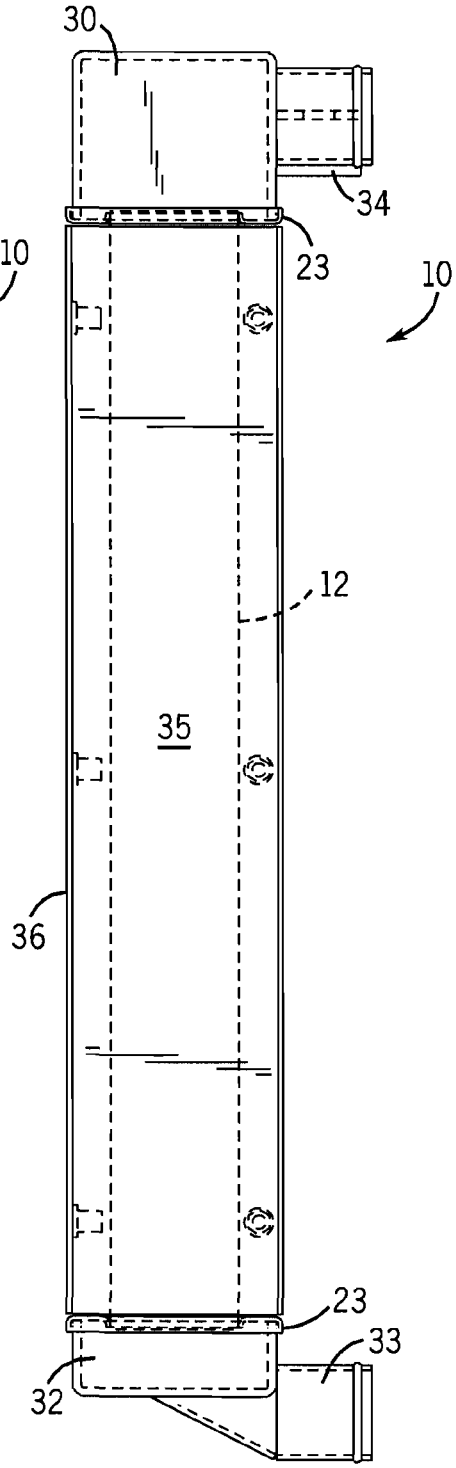
FIG. 2 is a side elevation view of the charge air cooler assembly of FIG. 1.
Figure 5:
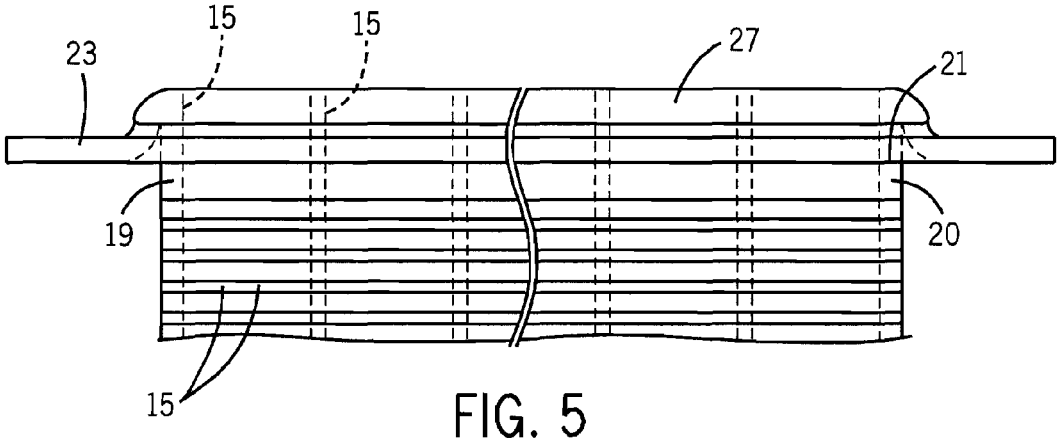
FIG. 5 is an enlarged side elevation showing the fused joints connecting the header plate to the assembly of tubular modules.

In FIGS. 1 and 2, there is shown an embodiment of the present invention that is adapted for use as a charge air cooler for a supercharged engine. The heat exchanger 10 is made of an assembly of extruded tubular aluminum modules 11. The slots 17 cut in the outer face portions 14 of the modules 11 to form the fins 13 do not extend the full length of the module. Instead, each module has unslotted ends 20 where there are no fins. Each of the opposite module ends terminates in a shoulder 21 formed in an endmost fin 19 of substantially greater thickness than intermediate fins 13. Each shoulder 21, in turn, surrounds an axially extending neck 22 which forms the terminal end of the through bores 15.

Figure 6:
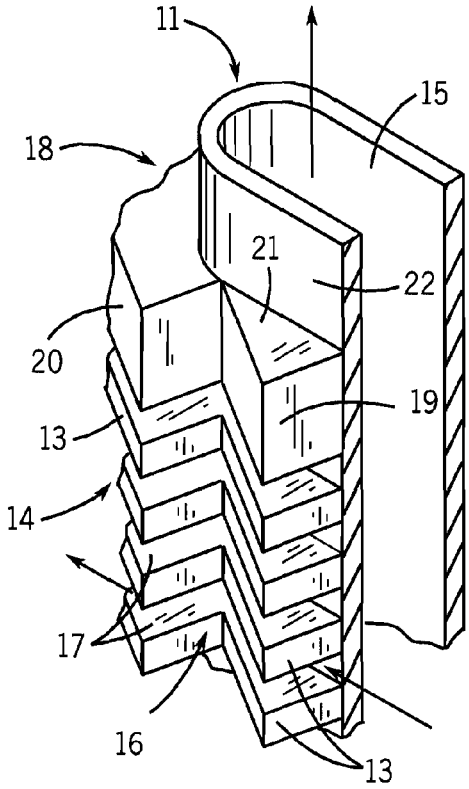
FIG. 6 is an isometric detail of the end of a tubular aluminum module forming a component of the assembly of FIG. 1.

Each module 11 includes a body 12 having toothed fins 13 formed in opposite face portions 14 and a plurality of longitudinal through bores 15 extending the length of each module 11 between the face portions 14 and in a direction transverse to the fins 13. The modules 11 are formed from aluminum extrusions that include the through bores 15 and V-shaped grooves 16 extending parallel to the bores in the exterior of each of the face portions 14, as shown in the FIG. 6 detail. The grooves 16 are subsequently cut laterally to form slots 17 which extend across the faces 14 perpendicular to the grooves 16 and between opposite edge faces 18 to define the saw-toothed fins 13. A header plate 23 is made of aluminum and includes a flat main body portion 24 which is provided with a series of openings 25 defined by upturned flanges 26 for receipt of the necks 22 of the module assembly. The underside of the flat body portion 24 of the header plate rests on the shoulders 21 of the endmost fins 19. Each header plate 23 is secured in position to the module assembly by forming fused joints 27 at the edges of the necks 22 and flanges 26. The fused joints 27 may be made with a conventional welding torch using substantially equal portions of neck and flange material.

It is important that the material used to form the fused joints 27 be thick enough to prevent collapse of either the flanges 26 or necks 22 and, in particular, to prevent molten aluminum from entering and potentially closing the bores 15. It has been found that the flanges and necks should be at least 0.090 inch (2.3 mm) in thickness. In addition, the greater thickness of the endmost fin 19 provides support for the header plate 23 and also helps insulate the thin intermediate fins 13 from excessive heat in the fusing operation.

The header plate 23 has a peripheral outer rim 28 that surrounds the center body portion 24 and to which is attached an upper tank 30 having a continuous lower edge 31 sized to fit closely within the outer rim 28 of the header plate and attached thereto with an air-tight weld or fused connection. The tank and welded connection are aluminum.

The lower header plate 23 and tank 32 are installed in the same manner. To complete the heat exchanger 10 for a typical charge air cooler application, the bottom tank 32 is provided with an inlet connection and the upper tank 30 is provided with an outlet connection 34. The outermost face portions 14 of the modules 11 at opposite edges of the assembly 10 are covered by side plates 35. Suitable mounting brackets 36 may be conveniently attached to the side plates 35 by welding or with mechanical fasteners.

In use, charge air is heated by a compressor, which may be driven by a turbine powered by exhaust pressure, to a high temperature, often in excess of 600° F. (315° C.). The heated compressed air enters the assembly via the inlet connection 33 in the lower tank 32. The flow from the tank is distributed uniformly to the lower ends of the through bores 15 in the modules 11 and flows vertically upwardly therethrough and into the upper tank 30. The cooled air exits the assembly via the outlet connection 34 for direct delivery as combustion air to the engine. The charge air cooler 10 is typically mounted to the vehicle to receive a direct flow of ambient cooling air through the slots 17 and past the fins 13 of the modules

What is claimed is:

1. A heat exchanger for a high temperature charge air cooler receiving air heated to 600° F. or higher, said heat exchanger comprising:

a plurality of unitary tubular aluminum heat exchange modules of a generally rectangular cross section, each module having at least one longitudinal through bore between opposite outer face portions which face portions are joined by opposite edge faces, said face portions provided with a plurality of grooves extending parallel to the through bore;

the outer face portions along substantially the full length of the module having formed therein slots that extend perpendicular to the through bore between said edge faces, said slots defining narrow heat exchange fins, said fins having a toothed shape, the endmost fin at each end of the module having a greater thickness than the fins therebetween and terminating adjacent a neck that surrounds and defines an end opening to said through bore, the neck having a wall thickness of at least about 0.090 in. (2.3 mm);

said plurality of modules arranged with the face portions of adjacent modules in juxtaposition;

an aluminum header plate for each end of said plurality of modules, each header plate having a plurality of openings defined by flanges and sized to receive the necks of the modules and to interconnect and hold the same in an assembly, the flanges having a wall thickness of at least about 0.090 in. (2.3 mm), each header plate supported on an endmost fin and closing the space defined by the tooth shaped fins between the necks of adjacent modules, and each header plate having a peripheral edge generally coincident with the outer periphery of the assembly; and, fused aluminum joints formed substantially equally from neck material and flange material, said joints providing air tight seams between each flange and the respective neck extending therethrough and connecting each header plate to the assembly.

2. The apparatus as set forth in claim 1 including a tank having a continuous outer edge connected to the peripheral edge of each header plate along an air tight joint.

3. The apparatus as set forth in claim 2 wherein the tank is made of aluminum and the air tight comprises an aluminum weld.

4. The apparatus as set forth in claim 1 wherein the fused aluminum joints lie entirely outside the through bores.

* * * * *